US007420508B2

(12) United States Patent
Ksienski et al.

(10) Patent No.: US 7,420,508 B2
(45) Date of Patent: Sep. 2, 2008

(54) HIGHER-ORDER INTERMODULATION REDUCTION USING PHASE AND ANGLE SMEARING

(75) Inventors: David A. Ksienski, Los Angeles, CA (US); James P. McKay, Hermosa Beach, CA (US); Samuel S. Osofsky, Rancho Palos Verdes, CA (US); Keven S. MacGowan, Rancho Palos Verdes, CA (US); Gwendolyn M. Shaw, Torrance, CA (US)

(73) Assignee: The Aerospace Corporation, El Segundo, CA (US)

( * ) Notice: Subject to any disclaimer, the term of this patent is extended or adjusted under 35 U.S.C. 154(b) by 23 days.

(21) Appl. No.: 11/354,551

(22) Filed: Feb. 14, 2006

(65) Prior Publication Data

US 2007/0188379 A1 Aug. 16, 2007

(51) Int. Cl.
*H01Q 3/00* (2006.01)

(52) U.S. Cl. ..... 342/372; 342/373

(58) Field of Classification Search ..... 342/81, 342/154, 157, 371–373
See application file for complete search history.

(56) References Cited

U.S. PATENT DOCUMENTS

| | | | | |
|---|---|---|---|---|
| 5,784,031 | A * | 7/1998 | Weiss et al. | 342/373 |
| 5,862,459 | A | 1/1999 | Charas | |
| 6,377,558 | B1 | 4/2002 | Dent | |
| 6,421,528 | B1 | 7/2002 | Rosen et al. | |
| 6,799,014 | B2 | 9/2004 | Rosen et al. | |
| 6,831,600 | B1 | 12/2004 | Cherrete et al. | |
| 6,856,284 | B1 * | 2/2005 | Cangiani | 342/372 |
| 6,882,868 | B1 | 4/2005 | Shattil | |
| 2002/0060993 | A1 | 5/2002 | Dent | |
| 2002/0080066 | A1 | 6/2002 | Dent | |
| 2002/0168974 | A1 | 11/2002 | Rosen et al. | |
| 2006/0003808 | A1 * | 1/2006 | Haskell et al. | 455/562.1 |
| 2007/0132634 | A1 * | 6/2007 | Wakeman | 342/174 |

OTHER PUBLICATIONS

U.S. Appl. No. 10/963,877, entitled "Phased Array Antenna Intermodulation Suppression Beam Smearing Method", filed Oct. 12, 2004.

* cited by examiner

*Primary Examiner*—Dao L Phan
(74) *Attorney, Agent, or Firm*—Henricks, Slavin & Holmes LLP

(57) ABSTRACT

A method for reducing intermodulation beams includes applying a beam-smearing phase distribution in addition to a beam-steering distribution for scanning to an array of antenna elements such that multiple higher-order intermodulation products are simultaneously reduced.

12 Claims, 19 Drawing Sheets

PHASE SMEARING EXCITATIONS AND FUNDAMENTAL QUADRANT BEAMS PRODUCED

THIRD-ORDER INTERMODULATION BEAMS PRODUCED BY EACH QUADRANT DUE TO PHASE SMEARING

FIFTH-ORDER INTERMODULATION BEAMS PRODUCED BY EACH QUADRANT DUE TO PHASE SMEARING

ANGLE SMEARING EXCITATIONS AND FUNDAMENTAL QUADRANT BEAMS PRODUCED

3rd IM
QUADRANT BEAMS

SIGNAL $S_3$
AT FREQUENCY $(2f_1 - f_2)$

SIGNAL $S_3'$
AT FREQUENCY $(2f_2 - f_1)$

THIRD-ORDER INTERMODULATION BEAMS PRODUCED
BY EACH QUADRANT DUE TO ANGLE SMEARING

5th IM
QUADRANT BEAMS

SIGNAL $S_5$
AT FREQUENCY $(3f_1 - 2f_2)$

SIGNAL $S_5$
AT FREQUENCY $(3f_2 - 2f_1)$

FIFTH-ORDER INTERMODULATION BEAMS PRODUCED
BY EACH QUADRANT DUE TO ANGLE SMEARING

INTERMODULATION CANCELLATION CIRCUIT THAT ELIMINATES THE THIRD-, NINTH-, FIFTEENTH-, ETC. ORDER INTERMODULATION BEAMS

14 X 14 ARRAY AND $J_1(u)/u$ ELEMENT PATTERN EMPLOYED TO DEMONSTRATE PHASE AND ANGLE SMEARING PERFORMANCE

FUNDAMENTAL BEAM DEGRADATION WITHIN ±0.5° SPOT AS A FIRST CRITERION TO EVALUATE PERFORMANCE

SMALLEST DEGRADATION =

PEAK DIRECTIVITY BEFORE SMEARING

- PEAK DIRECTIVITY AFTER SMEARING

INTERMODULATION BEAM DEGRADATION WITHIN ±8.6° EARTH FIELD OF VIEW AS A SECOND CRITERION TO EVALUATE PERFORMANCE

DEMONSTRATION THAT THE QUADRANT PHASE EXCITATIONS GIVEN BY $\phi = 90° - \psi$ AND $\phi = 90° + \psi$ ARE EQUIVALENT DIRECTIVITY DEGRADATION OF THE FUNDAMENTAL SPOT BEAMS AS A FUNCTION OF SMEAR ANGLE AND SMEAR PHASE DIRECTIVITY DEGRADATION OF THE FIFTH-ORDER INTERMODULATION BEAMS AS A FUNCTION OF SMEAR ANGLE AND SMEAR PHASE DIRECTIVITY DEGRADATION OF THE SEVENTH-ORDER INTERMODULATION BEAMS AS A FUNCTION OF SMEAR ANGLE AND SMEAR PHASE DIRECTIVITY DEGRADATION OF THE NINTH-ORDER INTERMODULATION BEAMS AS A FUNCTION OF SMEAR ANGLE AND SMEAR PHASE

| | SMEAR (°) | | DEGRADATION (dB) | | | |
|---|---|---|---|---|---|---|
| SCENARIO | PHASE | ANGLE | FUNDAMENTAL | 5th IM | 7th IM | 9th IM |
| 1 | 10 | 0.2 | 0.2 | 6.2 | 8.2 | 11.3 |
| 2 | 10 | 0.4 | 0.5 | 9.6 | 9.5 | 12.4 |
| 3 | 0 | 0.65 | 1.1 | 12.0 | 11.7 | 11.2 |

PERFORMANCE FOR THREE TYPICAL PHASE/ANGLE SMEARING SCENARIOS

FIG. 11

ANTENNA PATTERNS FOR THE FIRST PHASE/ANGLE SMEARING SCENARIO TABULATED IN FIG. 11

ANTENNA PATTERNS FOR THE FIRST PHASE/ANGLE SMEARING SCENARIO TABULATED IN FIG. 11

ANTENNA PATTERNS FOR THE SECOND PHASE/ANGLE SMEARING SCENARIO TABULATED IN FIG. 11

ANTENNA PATTERNS FOR THE SECOND PHASE/ANGLE SMEARING SCENARIO TABULATED IN FIG. 11

ANTENNA PATTERNS FOR THE THIRD PHASE/ANGLE SMEARING SCENARIO TABULATED IN FIG. 11

ANTENNA PATTERNS FOR THE THIRD PHASE/ANGLE SMEARING SCENARIO TABULATED IN FIG. 11

HIGHER-ORDER INTERMODULATION REDUCTION USING PHASE AND ANGLE SMEARING

STATEMENT OF GOVERNMENT INTEREST

The invention was made with Government support under contract No. FA8802-04-C-0001 by the Department of the Air Force. The Government has certain rights in the invention.

TECHNICAL FIELD

The invention relates generally to communication systems employing multiple simultaneous antenna beams and, in particular, to reducing intermodulation (IM) product beams in such communications systems.

BACKGROUND ART

Multiple simultaneous antenna beams required in communication systems are often achieved using active phased arrays. A common difficulty encountered in these systems is the generation of intermodulation product beams due to nonlinear effects. When these parasitic beams are produced at frequencies within the system operational bandwidth, signal-to-noise ratio and therefore overall system performance can degrade significantly.

It would be helpful to be able to reduce intermodulation product beams in such systems while having minimal impact on fundamental beams. It would also be helpful to be able to reduce intermodulation products that are higher than third order while having minimal impact on fundamental beams.

BRIEF DESCRIPTION OF THE DRAWINGS

FIG. 11 shows the performance for three example phase/angle smearing scenarios;

DISCLOSURE OF INVENTION

Example embodiments of the present invention involve systems and methods for reducing intermodulation product beams by simultaneously using phase and angle smearing and, in particular, extending the reduction to intermodulation products higher than third order. Generally, a phase distribution in addition to a progressive distribution (for beam scanning) is imposed on the array elements. In an example embodiment, phase excitations are used to reduce the magnitude of higher-order intermodulation beams caused by nonlinear effects in communication systems requiring multiple simultaneous beams. This reduction is achieved at a cost of minor degradation of the fundamental beams. In example embodiments, typical degradation of the fifth-, seventh-, and ninth-order beams ranges from 6 to 12 dB when the fundamental degradation ranges from 0.2 to 1.1 dB. In an example embodiment, an array is excited with a phase distribution that minimizes the peak directivity of higher-order intermodulation beams while having minimal impact on the fundamental beams.

Figure 1A:
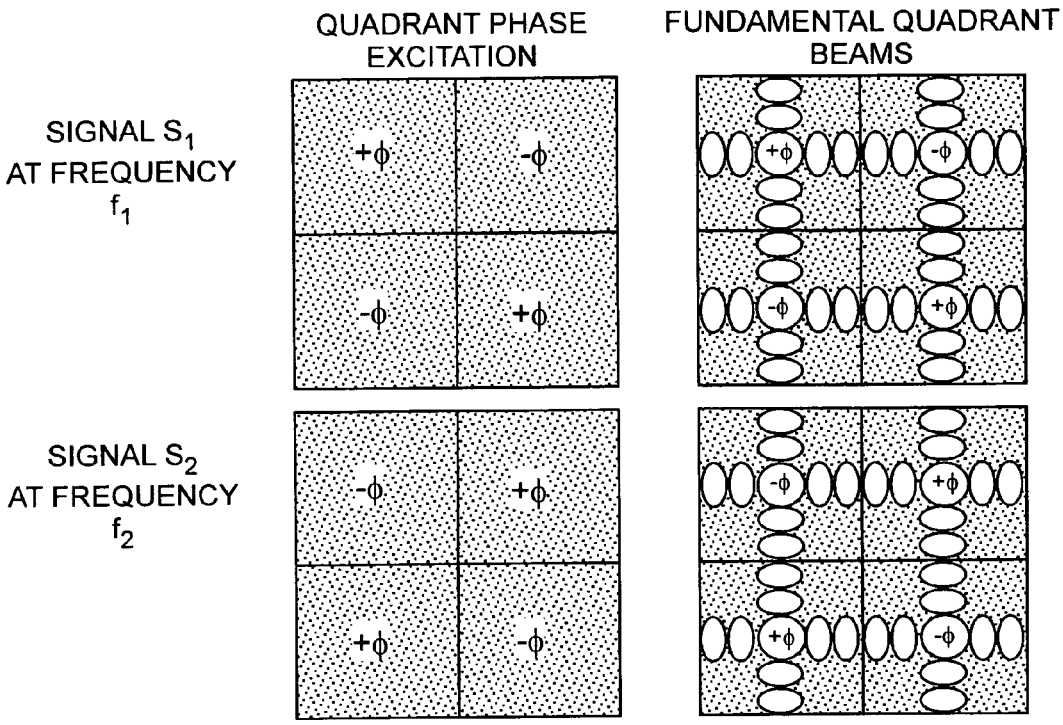
FIG. 1A illustrates example phase smearing array element excitations and fundamental quadrant beams produced.

FIG. 1A illustrates example array element excitations for implementing a phase smearing method, as well as its effects on the fundamental beams. Beginning with a square array that is divided into four quadrants, or subarrays, the elements in adjacent quadrants are then excited with positive and negative phase of the same amount. For a signal $S_1$, as shown in FIG. 1A, all elements in quadrants 1 and 3 are excited with phase $-\phi$, and all elements in quadrants 2 and 4 are excited with phase $+\phi$, where the value of $\phi$ is selected to optimize performance. In an example embodiment, performance is optimized according to the method of FIG. 15 (discussed below), by deciding which intermodulation beams are to be targeted, the amount by which these beams must be degraded, and how much accompanying fundamental beam degradation can be tolerated. For another signal $S_2$, also shown in FIG. 1A, all elements in quadrants 1 and 3 are excited with phase $+\phi$, and all elements in quadrants 2 and 4 are excited with phase $-\phi$. The resulting far-field phases of the fundamental beams produced by each quadrant are similarly $\pm\phi$, as shown in FIG. 1A. It is important to note that the smear phases are independent of the conventional uniform progressive phase distributions across the aperture required to achieve the two desired scanned spot beams.

To understand the effects of phase smearing on the third-order intermodulation beams, first consider two sine wave functions given by $$f_1(t)=\sin(\omega_1 t+\phi_1)$$

$$f_2(t)=\sin(\omega_2 t+\phi_2) \quad (1)$$

The functional form of associated third-order nonlinearities is revealed by constructing the function g(t) given by $$g(t)=[f_1(t)+f_2(t)]^3 \quad (2)$$

It is instructive to expand the right hand side of equation (2) so that all terms consist of sinusoids having arguments that are either integer multiples, sums of integer multiples, or differences of integer multiples of $(\omega_1 t+\phi_1)$ and $(\omega_2 t+\phi_2)$. The terms expected to be the most problematic in a communication system are those sinusoids $f_3(t)$ and $f_3'(t)$ having arguments that are differences of consecutive integer multiples, i.e., $$f_3(t)=\sin[2(\omega_1 t+\phi_1)-(\omega_2 t+\phi_2)]$$

$$f_3'(t)=\sin[2(\omega_2 t+\phi_2)-(\omega_1 t+\phi_1)] \quad (3)$$

By letting $$\phi_2=-\phi_1=\phi \quad (4)$$

then the functions given in equation (3) become $$f_3(t)=\sin[(2\omega_1-\omega_2)t-3\phi]$$

$$f_3'(t)=\sin[(2\omega_2-\omega_1)t+3\phi] \quad (5)$$

Equation (5) reveals that the magnitude of the phase constants of problematic third-order intermodulation terms is three times that of the fundamental functions from which they are generated.

Figure 1B:
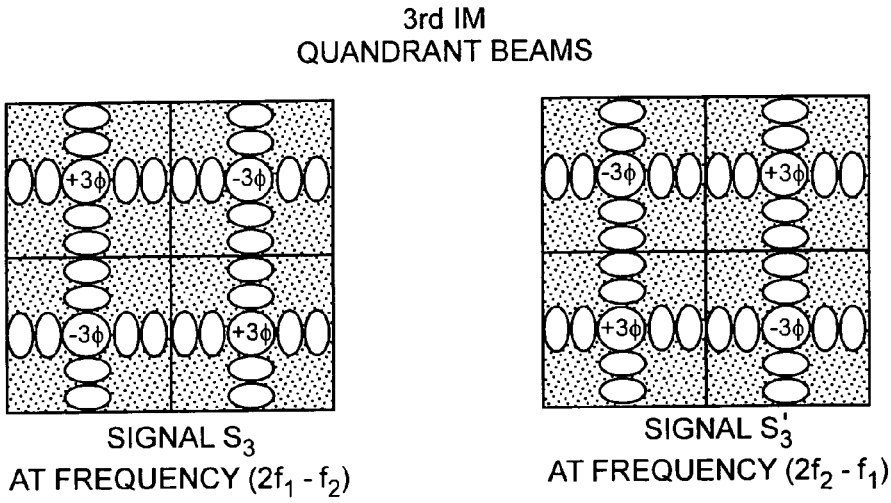
FIG. 1B shows third-order intermodulation beams produced by each quadrant due to phase smearing.
Figure 1C:
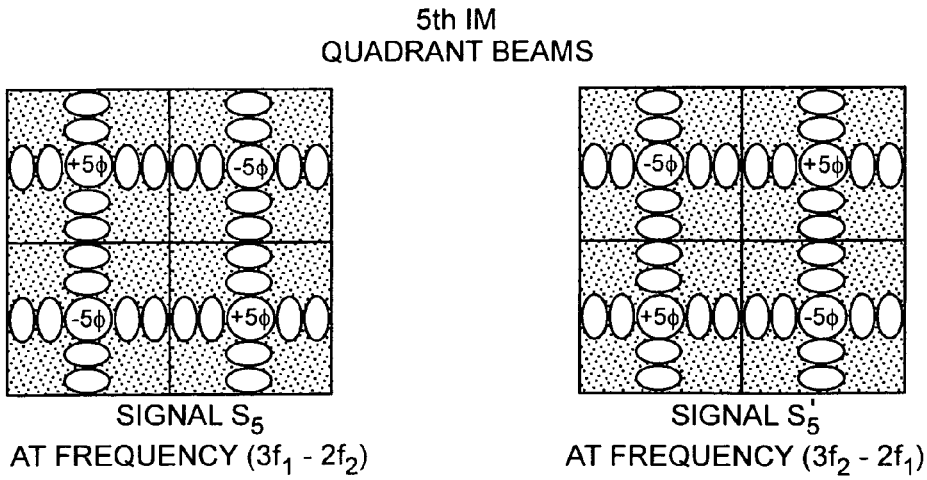
FIG. 1C shows fifth-order intermodulation beams produced by each quadrant due to phase smearing.

Because the resulting phase excitation of each element for these third-order intermodulation signals is three times the phase excitation for the fundamental signals, the far-field phases of the third-order intermodulation beams produced by each quadrant of the array are $\pm 3\phi$, as shown in FIG. 1B. Therefore, the phase smearing excitation effectively degrades the third-order intermodulation beams by three times as much as it degrades the fundamental beams. Similarly, it can be shown that the phase excitation of each element for the problematic fifth-order intermodulation signals is five times the phase excitation for the fundamental signals, so that the far-field phases of the fifth-order intermodulation beams produced by each quadrant are $\pm 5\phi$, as shown in FIG. 1C. Therefore, the phase smearing excitation effectively degrades the fifth-order intermodulation beams by five times as much as it degrades the fundamental beams.

Figure 2A:
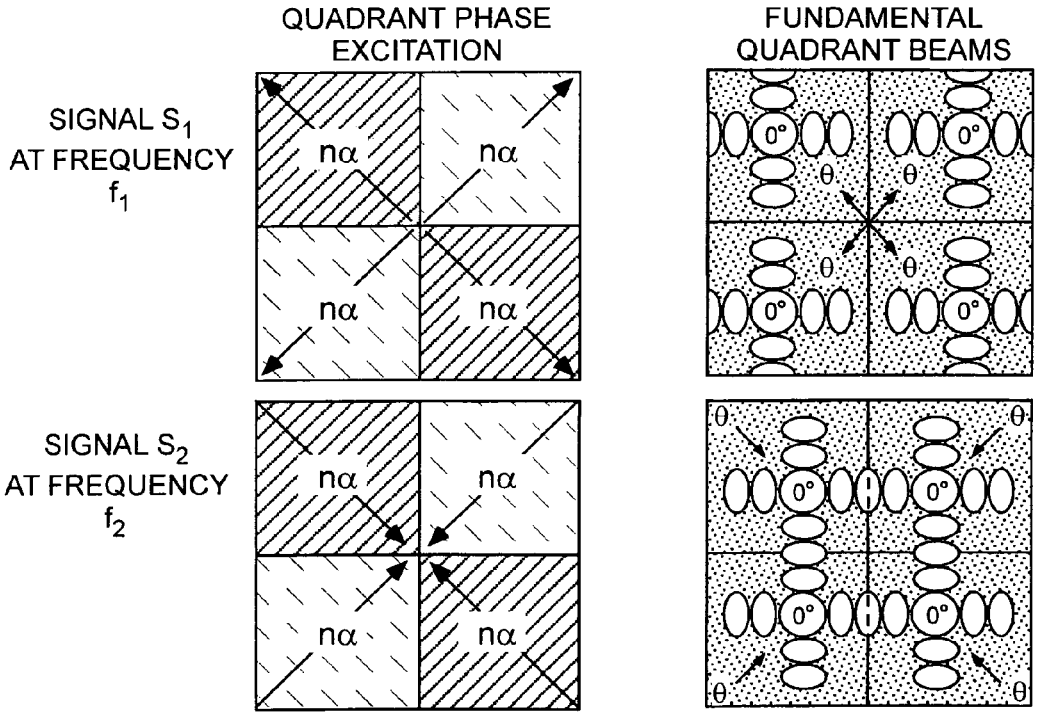
FIG. 2A illustrates example angle smearing array element excitations and fundamental quadrant beams produced.

FIG. 2A illustrates the array element excitations for implementing an example angle smearing method, as well as its effects on the fundamental beams. As in the phase smearing method, beginning by dividing a square array into four subarrays, all four quadrants are then excited with identical uniform progressive phase distributions that steer each quadrant beam away from the array boresight. For a signal $S_1$, as shown in FIG. 2A, each of the four fundamental quadrant beams is scanned away from the diametrically opposite quadrant. For a signal $S_2$, also shown in FIG. 2A, each of the four fundamental quadrant beams is scanned toward the diametrically opposite quadrant. The amount of scan, given by the smear angle θ, is selected to optimize performance. In an example embodiment, performance is optimized according to the method of FIG. 15 (discussed below), by deciding which intermodulation beams are to be targeted, the amount by which these beams must be degraded, and how much accompanying fundamental beam degradation can be tolerated. It is important to note that the uniform progressive phase distributions that give rise to the quadrant beam scans are superposed upon, and independent of, the uniform progressive phase distributions across the full aperture required to achieve the two desired scanned spot beams.

Figure 2B:
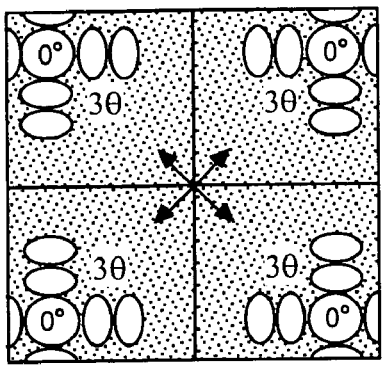
FIG. 2B shows third-order intermodulation beams produced by each quadrant due to angle smearing.
Figure 2B:
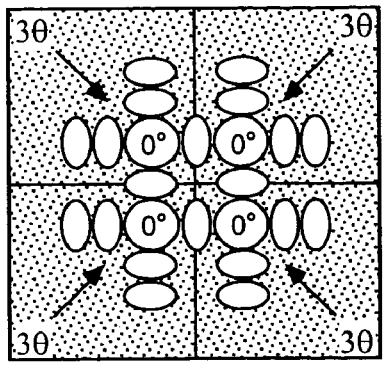
Figure 2C:
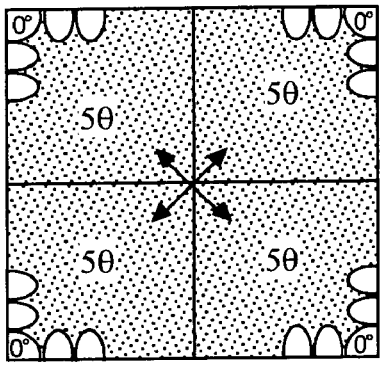
FIG. 2C shows fifth-order intermodulation beams produced by each quadrant due to angle smearing.
Figure 2C:
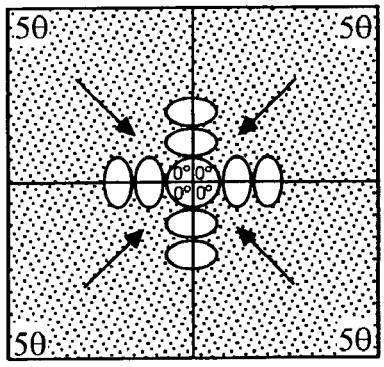

Because the phase excitation of each element for the third-order intermodulation signals is three times the phase excitation for the fundamental signals, the third-order intermodulation beams generated by each quadrant are steered by approximately three times as much, as shown in FIG. 2B. Therefore, the angle smearing excitation effectively degrades the third-order intermodulation beams by three times as much as the fundamental beams. Similarly, the phase excitation of each element for the fifth-order intermodulation signals is five times the phase excitation for the fundamental signals, so that the fifth-order intermodulation beams generated by each quadrant are steered by five times as much, as shown in FIG. 2C. Therefore, the phase smearing excitation effectively degrades the fifth-order intermodulation beams by five times as much as it degrades the fundamental beams.

Figure 3:
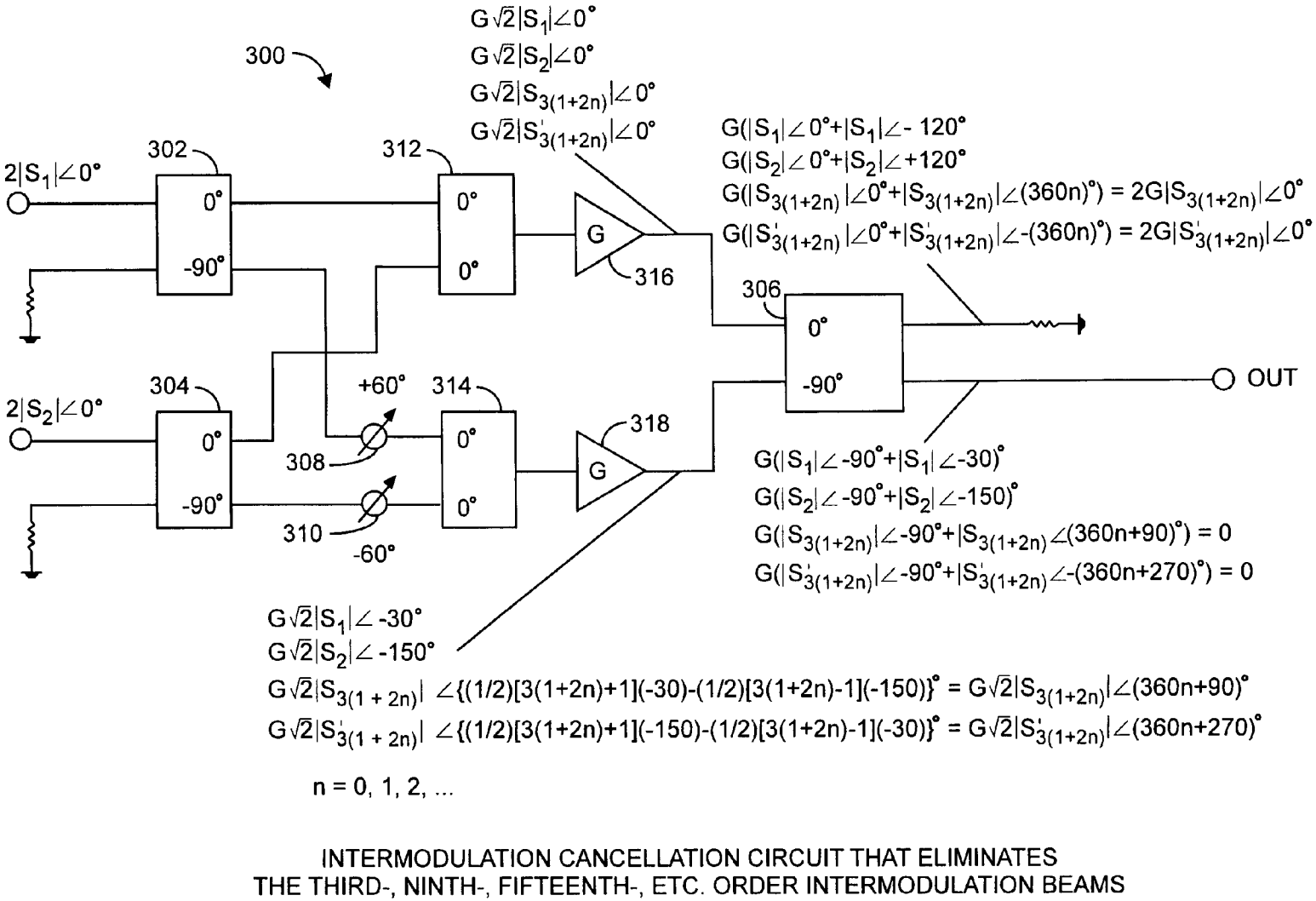
FIG. 3 shows an example embodiment of an intermodulation cancellation circuit configured for eliminating the third-, ninth-, fifteenth-, etc. order intermodulation beams.

FIG. 3 illustrates an example embodiment of an intermodulation cancellation circuit 300 that eliminates intermodulation product signals prior to their arrival at the antenna elements. In this example embodiment, the intermodulation cancellation circuit 300 includes hybrid couplers 302, 304 and 306, fixed phase shifters 308 and 310, Wilkinson power dividers 312 and 314, and amplifiers 316 and 318, configured as shown. In this example embodiment, the intermodulation cancellation circuit 300 eliminates not only the third-order signals, but also the problematic ninth-, fifteenth-, twenty-first-, etc. order signals. These are the intermodulation products generated at frequencies $f_9=5f_1-4f_2$, $f_9'=5f_2-4f_1$, $f_{15}=8f_1-7f_2$, $f_{15}'=8f_2-7f_1$, etc. More generally, it can be shown that in this example embodiment the intermodulation cancellation circuit 300 eliminates the problematic intermodulation products of order N given by $$N=3(1+2n) \quad (6)$$

where n=0, 1, 2, . . . Complete cancellation requires perfect balance in the circuit which in practice cannot be achieved due to non-ideal or non-identical components and temperature gradients or other environmental effects. Additionally, these network imperfections have a greater impact when attempting to cancel higher-order intermodulation products. In this example embodiment, the intermodulation cancellation circuit 300—by virtue of greatly reducing the third- and ninth-order intermodulation products—allows phase and angle smearing efforts to be directed more toward minimizing the fifth- and seventh-order intermodulation products.

Figure 4:
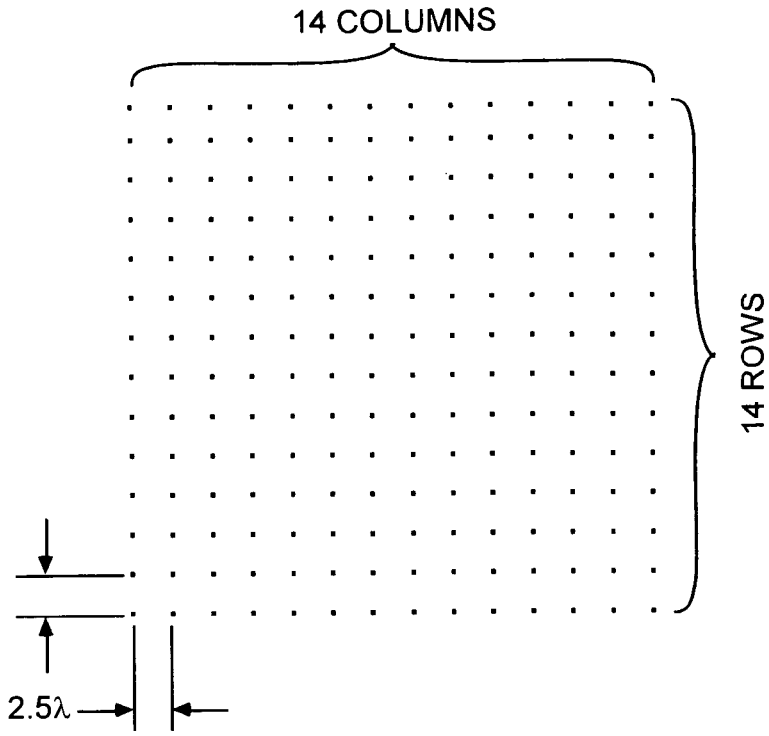
FIG. 4 shows an example 14×14 array and $J_1(u)/u$ element pattern employed to demonstrate phase and angle smearing performance.
Figure 4:
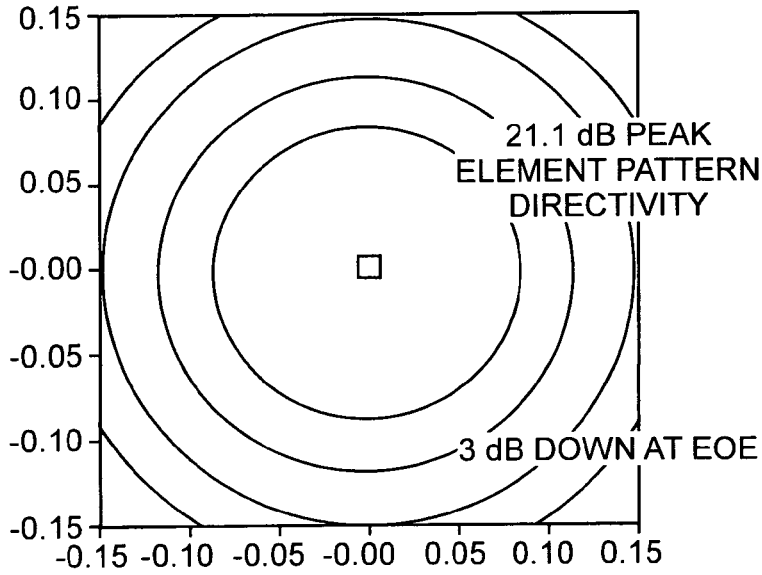

The phase and angle smearing techniques were evaluated with a 14×14 spot beam array design that, for example, can be employed to achieve Earth-coverage communication from a geosynchronous satellite. FIG. 4 shows the array layout and element pattern. In this example, the elements were assumed to be identical, excited uniformly in amplitude, and laid out on a square grid with a spacing of 2.5 wavelengths. The pattern of each element was modeled using a circularly symmetric $J_1(u)/u$ function, where $J_1$ is the Bessel function of the first kind, and u is proportional to the sine of the angle from the element boresight. The element pattern peak directivity was 21.1 dB and decreased by 3 dB at the edge of Earth (EOE), which was assumed to be 8.6° from the antenna boresight. All directivity patterns of the array were generated using the satellite industry standard software General Reflector Antenna and Antenna Farm Analysis Program (GRASP).

Figure 5A:
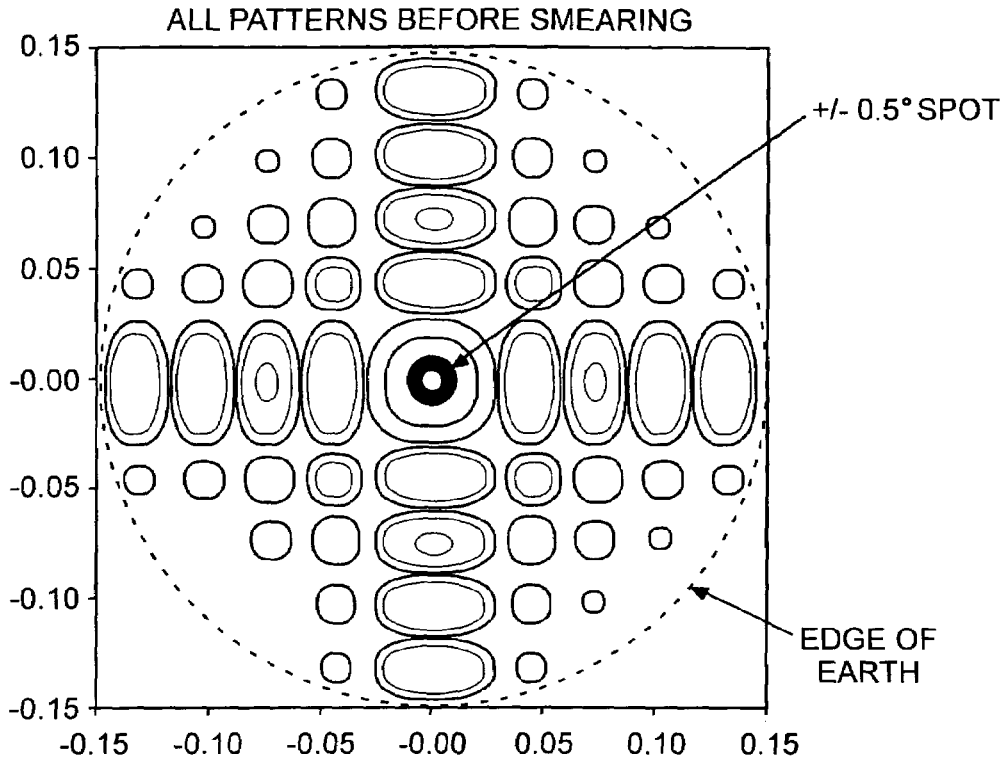
FIG. 5A shows fundamental beam degradation within ±0.5° spot as an example first criterion to evaluate performance.
Figure 5A:
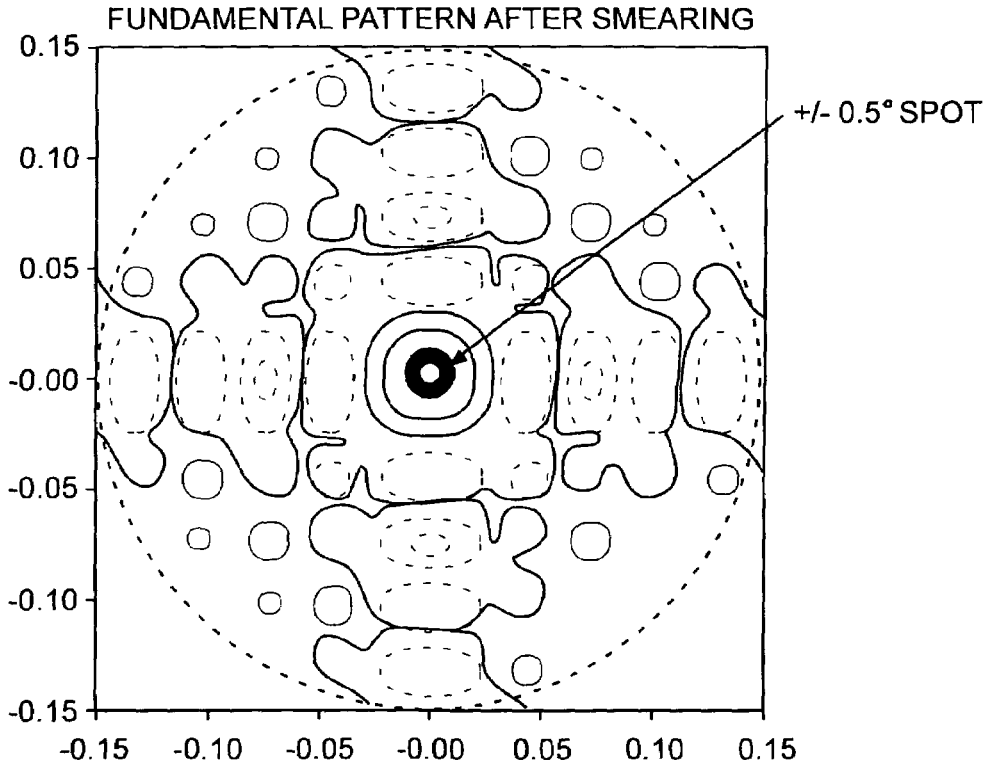
Figure 5B:
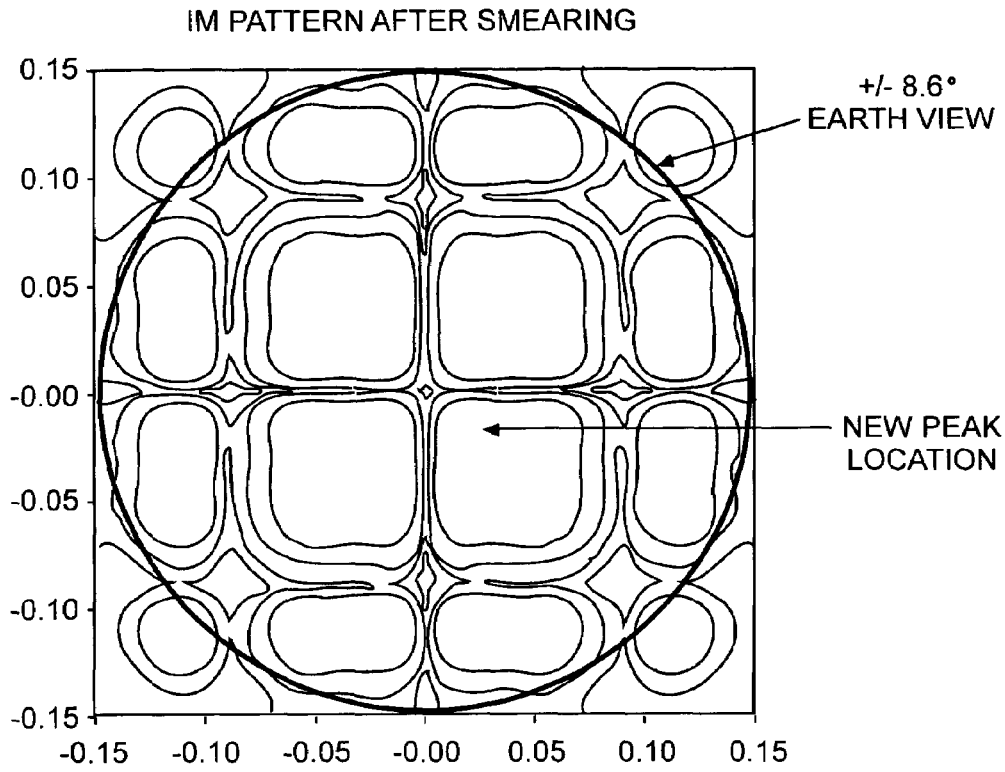
FIG. 5B shows intermodulation beam degradation within ±8.6° earth field of view as an example second criterion to evaluate performance.

Performance was evaluated using the two criteria shown in FIGS. 5A and 5B. Because phase and angle smearing affect the fundamental beams as well as the intermodulation beams, the degradations of both were evaluated. FIG. 5A displays the directivity pattern for the fundamental beams of the 14×14 array projected onto the Earth's disk from geosynchronous orbit, both before and after changing the element phase distribution to implement combined phase and angle smearing. Although smearing produces significant effects on the sidelobes of the fundamental pattern, the small amount of smearing generally required typically has only minor effects on the spot beam, which is assumed to occupy a small angular region less than 0.5° from the antenna boresight. This small region is assumed to be of prime importance for the communication system, and so the maximum directivity degradation within this region is used as a first criterion to evaluate performance.

FIG. 5B displays a typical directivity pattern for the intermodulation beams projected onto the earth after the element phase distribution has been changed to implement combined phase and angle smearing. Before smearing is implemented, the directivity pattern of the intermodulation beams is identical to that of the fundamental beams, shown in FIG. 5A. In the directivity pattern of FIG. 5B, the significant effects of smearing at all angles can be seen, including in the boresight direction that contains the fundamental spot beams. Because high intermodulation beam directivity can degrade system performance regardless of where the beam peaks occur on the earth, the difference between the peak directivity of the intermodulation pattern before and after smearing is implemented is used as a second smearing performance criterion.

Figure 6:
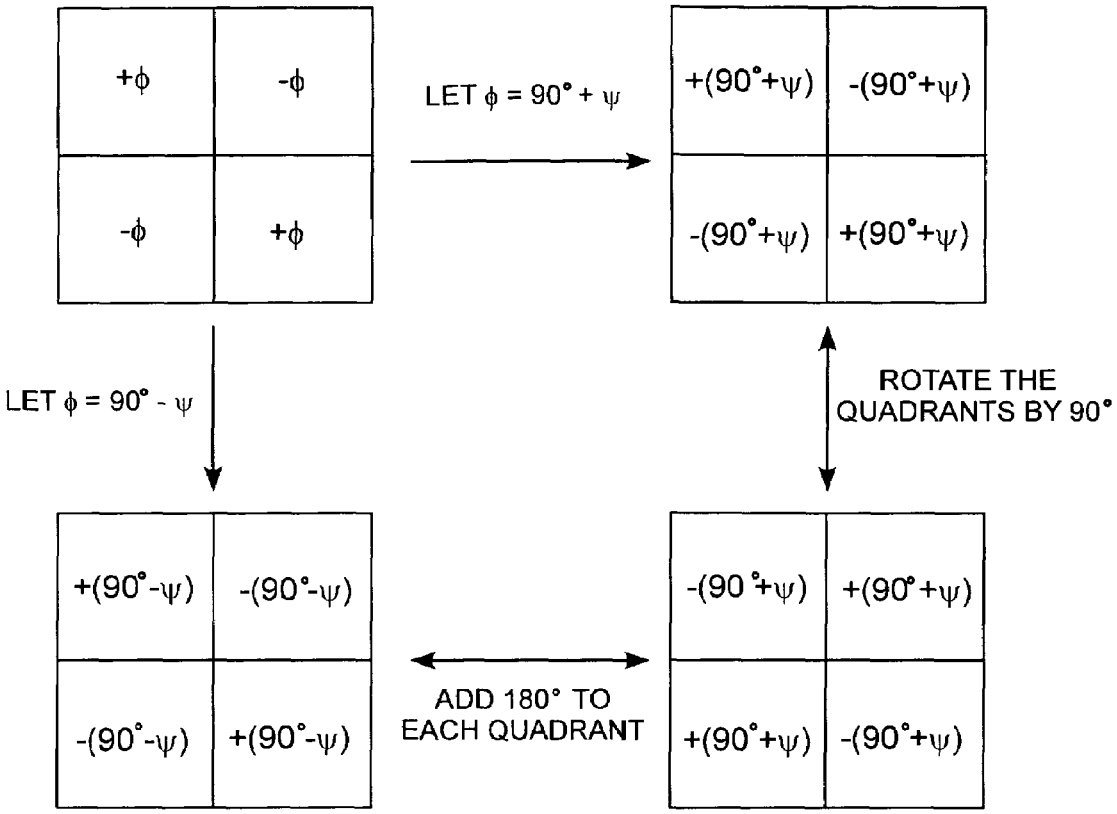
FIG. 6 demonstrates that the quadrant phase excitations given by $\phi=90°-\psi$ and $\phi=90°+\psi$ are equivalent.

In order to optimize performance using combined phase and angle smearing, it is important to be aware of symmetries associated with phase smearing. As illustrated in FIG. 6, phase smearing performance is symmetric with respect to a quadrant phase $\phi$ of 90°. That is, the array directivity pattern for a quadrant phase excitation using $\phi=\pm(90°+\psi)$ is identical to that for a quadrant phase excitation using $\phi=\pm(90°-\psi)$, where $\psi$ is any arbitrary angle. This is shown in FIG. 6, in which these two different phase excitations are generated from one another by performing two simple operations that do not affect the array far-field directivity pattern: a physical rotation of the quadrants by 90° about the array boresight axis, and an addition of 180° to each quadrant phase. More generally, it is straightforward to show that the array directivity pattern for a quadrant phase excitation using $\phi=\pm(n90°+\psi)$ is identical to that for a quadrant phase excitation using $\phi=\pm(n90°-\psi)$, where n=1, 3, 5, . . . Symmetry for larger values of $\phi$ becomes more important when attempting to minimize increasingly higher-order intermodulation products.

Figure 7:
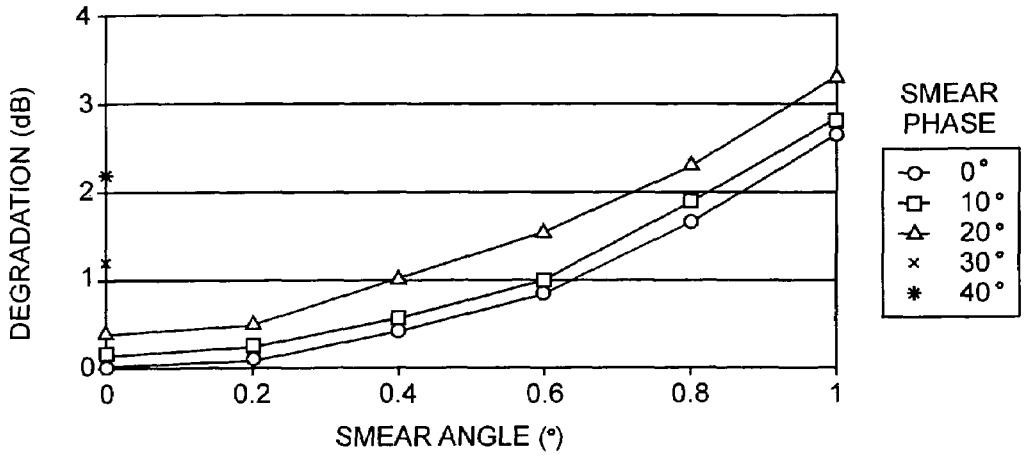
FIG. 7 is a plot of directivity degradation of the fundamental spot beams as a function of smear angle and smear phase.

In FIG. 7, the degradation in directivity of the fundamental beams is plotted as a function of smear angle and smear phase. In this example, smear angle is varied from 0° to 1° and smear phase is varied from 0° to 40°. Only one point is shown for each of the smear phases of 30° and 40°, since for these smear phases the degradation is greater than 1.2 dB and it is expected that the use of such a large smear phase would be relatively unlikely. In FIG. 7, it can be seen that the degradation increases more or less monotonically with both smear angle and smear phase.

Figure 8:
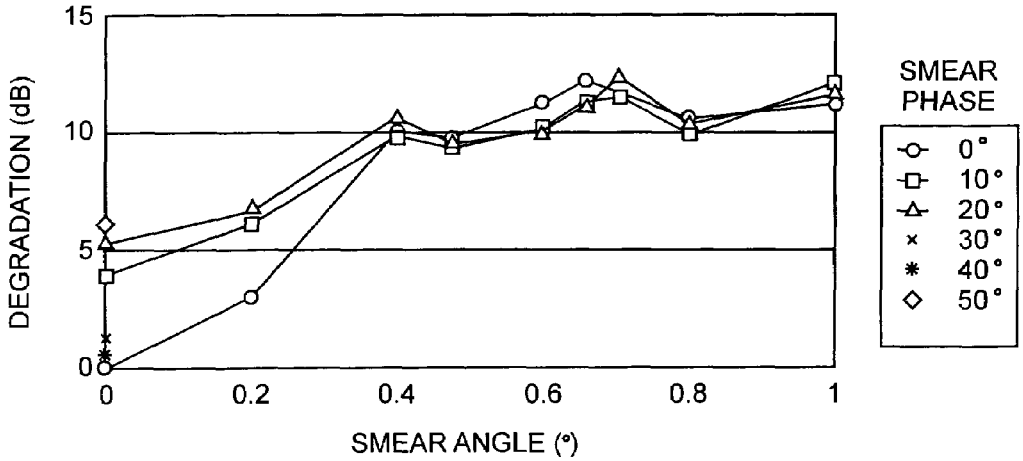
FIG. 8 is a plot of directivity degradation of the fifth-order intermodulation beams as a function of smear angle and smear phase.

In FIG. 8, the degradation in directivity of the fifth-order intermodulation beams is plotted as a function of smear angle and smear phase. For small values of smear angle, the degradation is strongly dependent upon the smear phase, increasing rapidly with smear phase until the symmetry effect discussed above causes the degradation to drop. For larger values of smear angle, the degradation is relatively insensitive to smear phase. Large degradation of about 10 dB can be achieved with a smear angle of just 0.4°, while an additional 2-3 dB of degradation can be achieved if the smear angle is increased to 0.6°.

Figure 9:
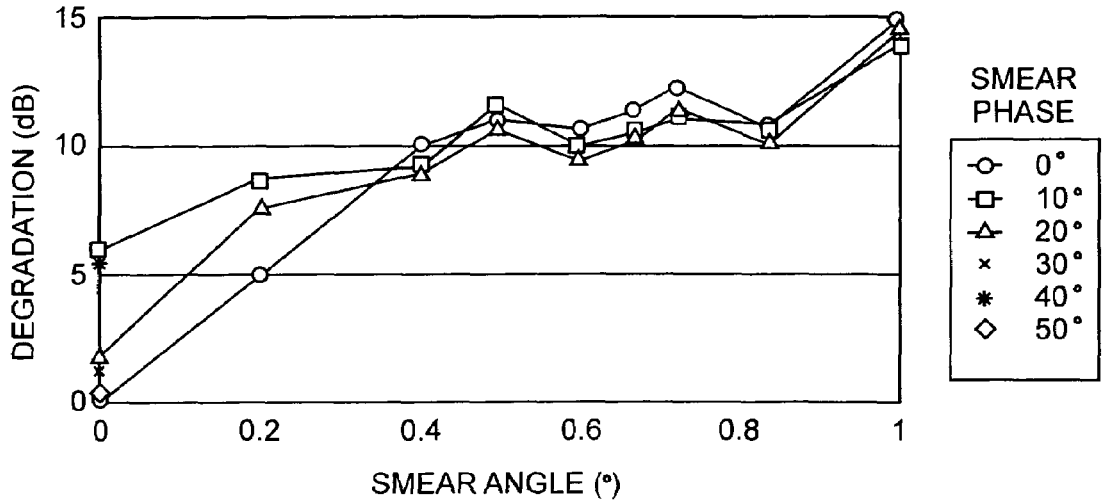
FIG. 9 is a plot of directivity degradation of the seventh-order intermodulation beams as a function of smear angle and smear phase.
Figure 10:
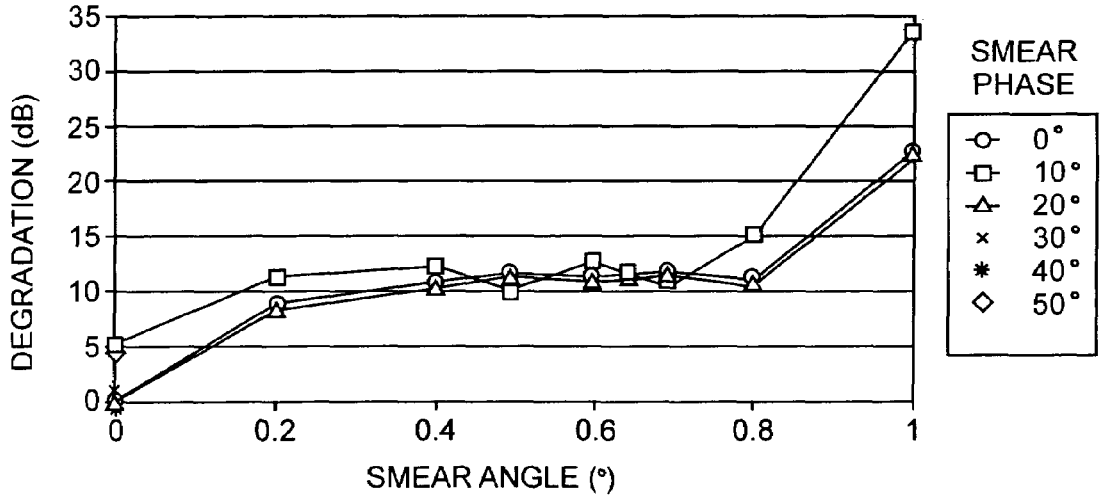
FIG. 10 is a plot of directivity degradation of the ninth-order intermodulation beams as a function of smear angle and smear phase.

In FIGS. 9 and 10, the degradations in directivity of the seventh- and ninth-order intermodulation beams, respectively, are plotted as functions of smear angle and smear phase. Both the seventh- and ninth-order degradations are strongly dependent on smear phase when smear angle is small. When the smear angle is greater than about 0.3°, the seventh-order degradation is relatively insensitive to smear phase, and tends to increase gradually with smear angle, reaching one local maximum when the smear angle is about 0.5°. The ninth-order degradation is relatively insensitive to both smear angle and smear phase when smear angle is between 0.4° and 0.7°, but increases rapidly, and is strongly dependent on smear phase as smear angle is increased further. The smear phase symmetry effect is clearly evident in FIG. 10, which shows that the ninth-order degradation is identical for smear phases of 0°, 20°, and 40°, as well as for smear phases of 10°, 30°, and 50°.

If degradation of a particular intermodulation beam is critical or desired, the set of curves of fundamental degradation given in FIG. 7 can be used with any one of the three sets of curves given in FIGS. 8-10. Alternatively, all four sets of curves given in FIGS. 7-10 can be used in an attempt to simultaneously minimize as many intermodulation beams as possible. The results of this type of optimization are tabulated in FIG. 11, which shows three examples of phase and angle smearing schemes that can be utilized in order to simultaneously minimize the fifth-, seventh- and ninth-order intermodulation beams while incurring various degradations of the fundamental beams.

In an example embodiment, a method for reducing intermodulation beams includes applying a beam-smearing phase distribution in addition to a beam-steering distribution for scanning to an array of antenna elements such that multiple higher-order intermodulation products are simultaneously reduced.

In an example embodiment, a method for reducing intermodulation beams includes applying phase shifts to two fundamental beams such that the directivity of higher-order intermodulation products of the two fundamental signals is reduced more than the directivity of the fundamental beams.

Figure 12A:
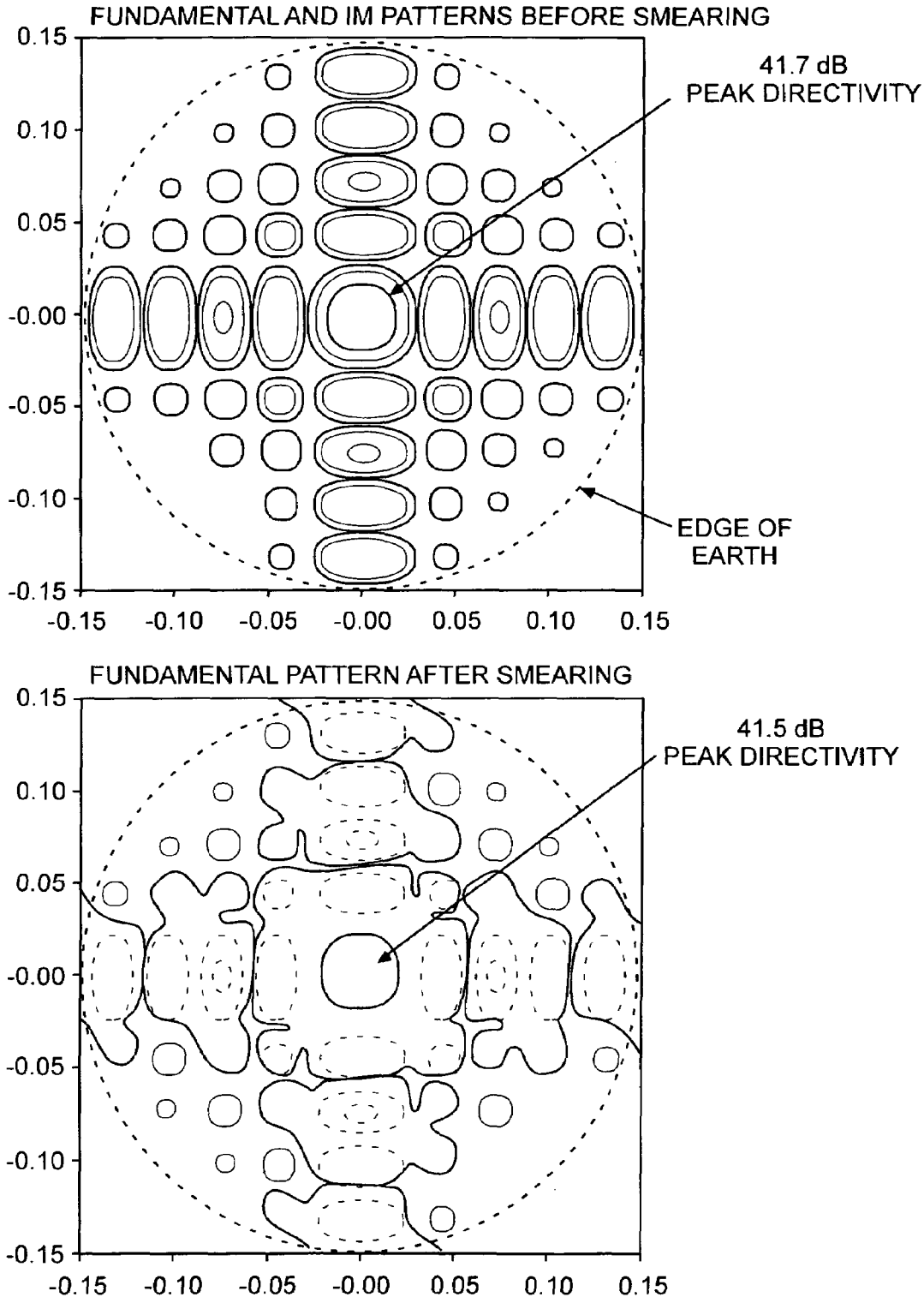
FIGS. 12A and 12B show antenna patterns for the first phase/angle smearing scenario of FIG. 11.
Figure 12B:
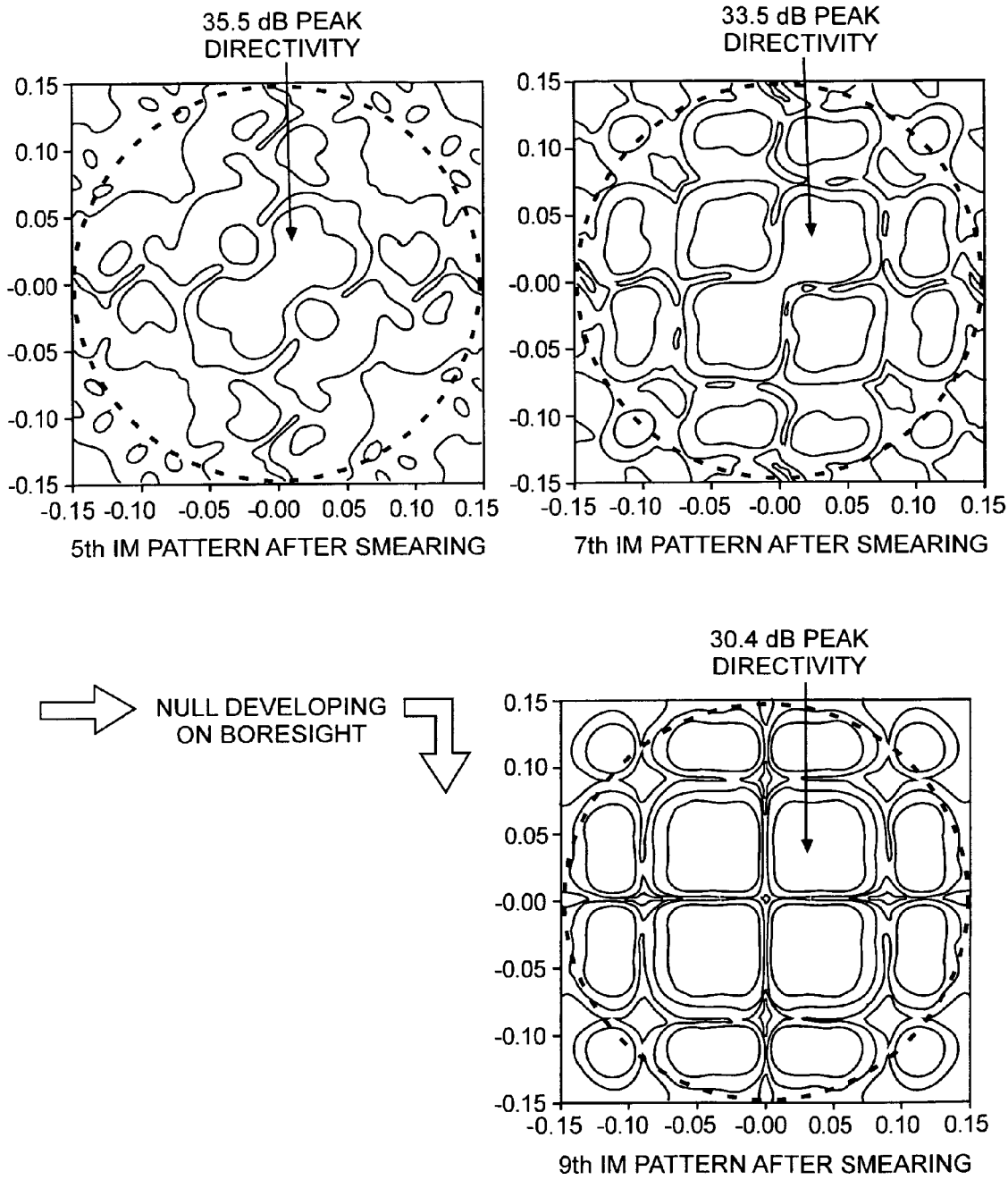

The first scenario tabulated in FIG. 11 has been selected to meet a hypothetical requirement that only a minimal degradation of the fundamental beams can be tolerated. In this example scenario—achieved using a smear phase of 10° and a smear angle of 0.2°—the fifth-, seventh- and ninth-order beams are degraded by 6.2, 8.2, and 11.3 dB respectively while minimally affecting the fundamental beams, which are degraded by just 0.2 dB. The fundamental and intermodulation directivity patterns for the first scenario before and after smearing are shown in FIGS. 12A and 12B. The spot beam of the fundamental patterns is virtually unchanged; only the sidelobe structure is altered. In contrast, the directivity patterns for the fifth-, seventh- and ninth-order intermodulation products are significantly altered by phase and angle smearing. FIGS. 12A and 12B show the increasing effects of smearing for increasing intermodulation beam order. The fifth-order pattern shows the beginnings of a boresight null, which is more evident in the seventh-order pattern, and very well-defined in the ninth-order pattern, which clearly displays a quadripartite beam. In this example, the peak directivities for the fifth-, seventh-, and ninth-order intermodulation patterns are 35.5, 33.5, and 30.4 dB respectively.

Figure 13A:
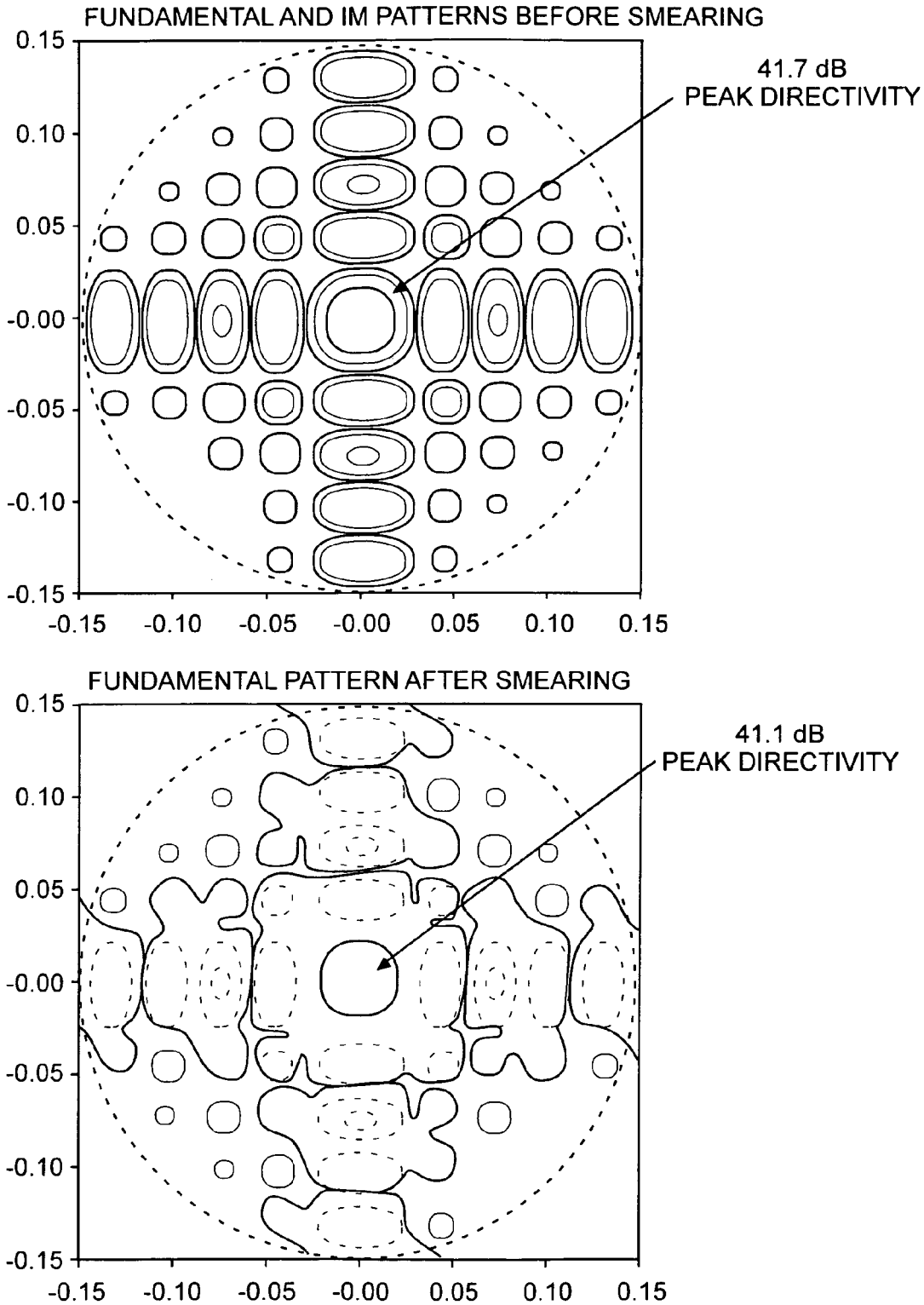
FIGS. 13A and 13B show antenna patterns for the second phase/angle smearing scenario of FIG. 11.
Figure 13B:
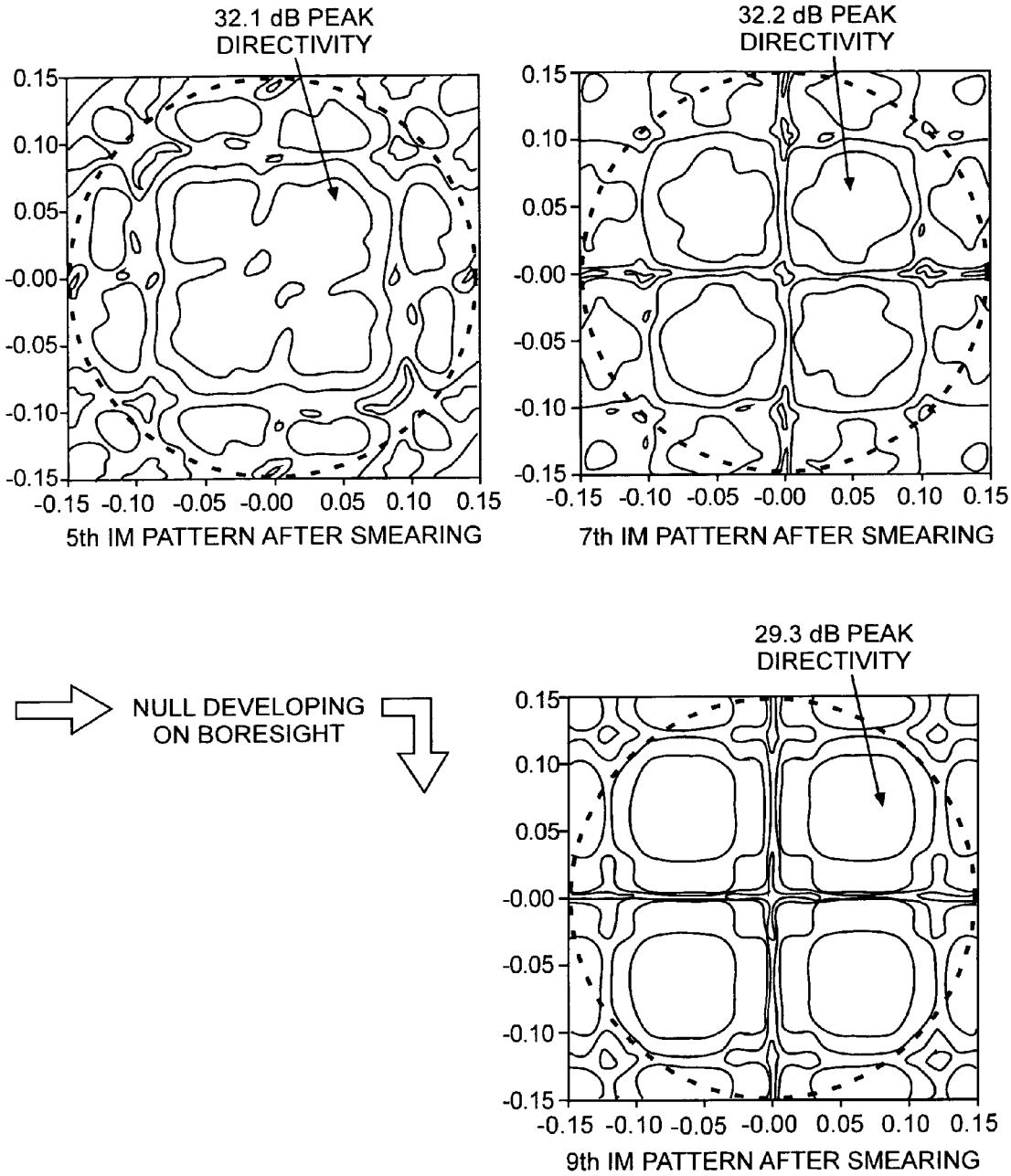

The second scenario tabulated in FIG. 11 has been selected to meet a hypothetical requirement that a moderate amount of fundamental beam degradation can be tolerated. In this example scenario—achieved using a smear phase of 10° and a smear angle of 0.4°—the fifth-, seventh- and ninth-order beams are degraded by 9.6, 9.5 and 12.4 dB respectively while the fundamental beams are degraded by just 0.5 dB. The directivity patterns for the second scenario before and after smearing are shown in FIGS. 13A and 13B. The fundamental spot beam is again virtually unchanged, with only the sidelobe structure significantly altered. Again, the increasing effects of smearing for increasing intermodulation beam order are evident, with a boresight null and quadripartite beam already visible in the seventh-order pattern. The ninth-order pattern displays an angular broadening of the boresight null. In this example, the peak directivities for the fifth-, seventh-, and ninth-order intermodulation patterns are 32.1, 32.2, and 29.3 dB respectively.

Figure 14A:
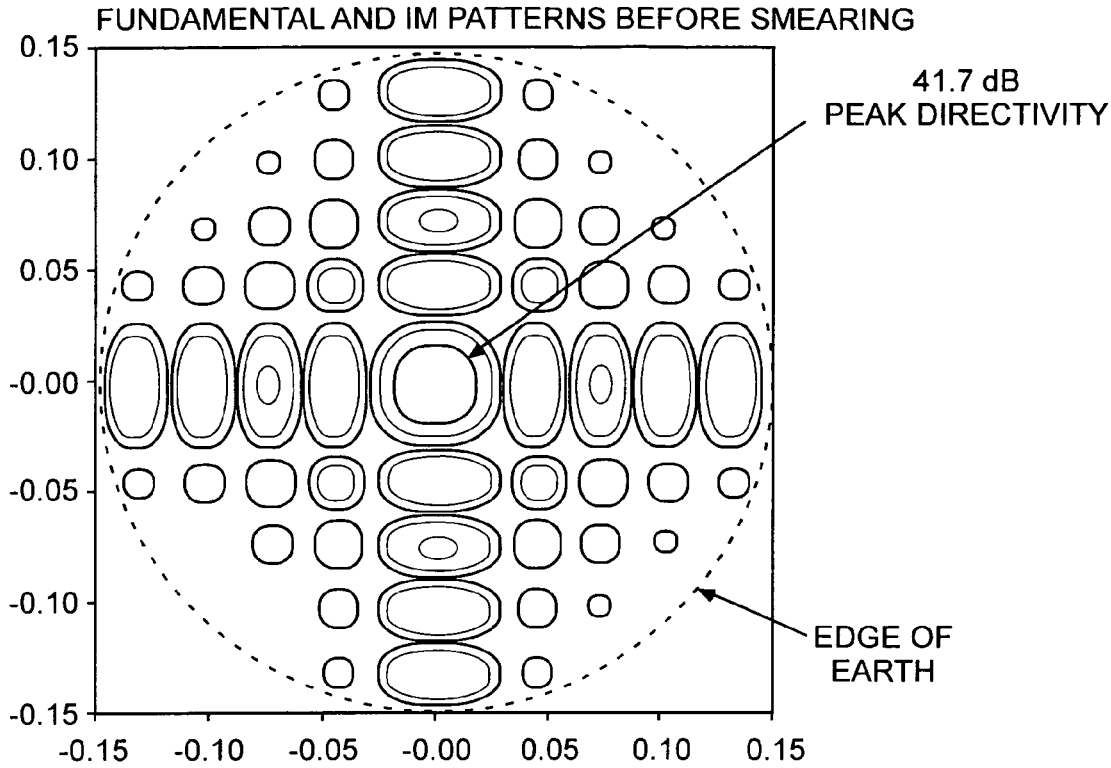
FIGS. 14A and 14B show antenna patterns for the third phase/angle smearing scenario of FIG. 11.
Figure 14A:
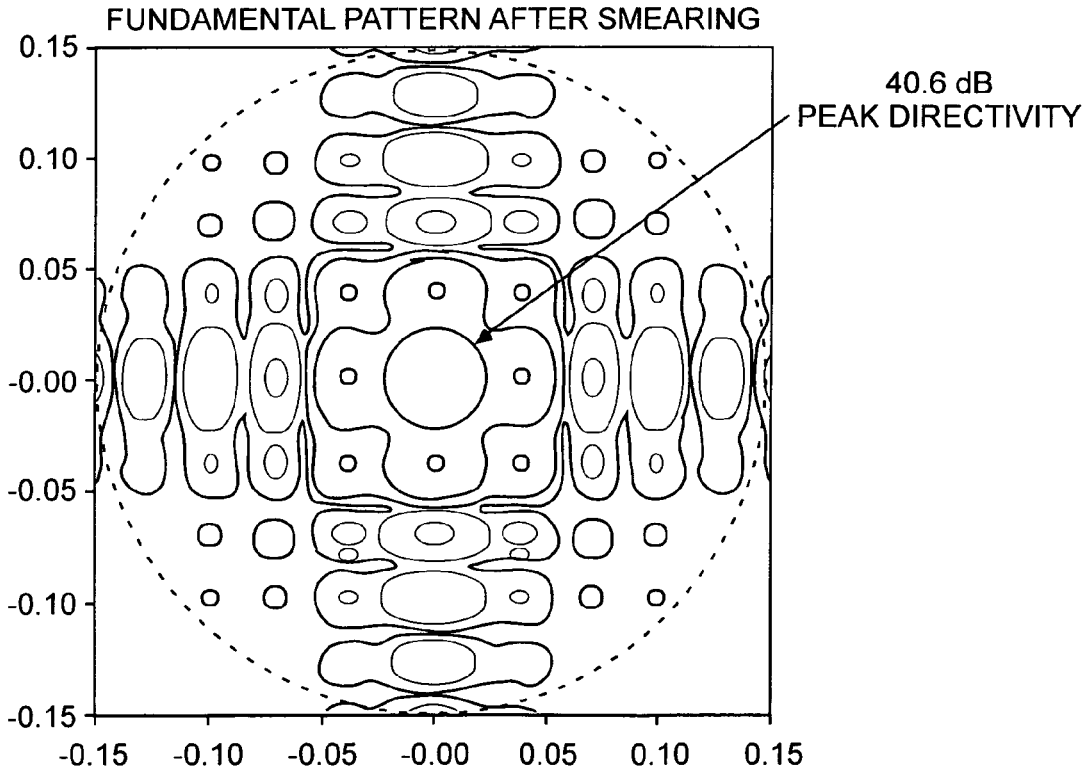
Figure 14B:
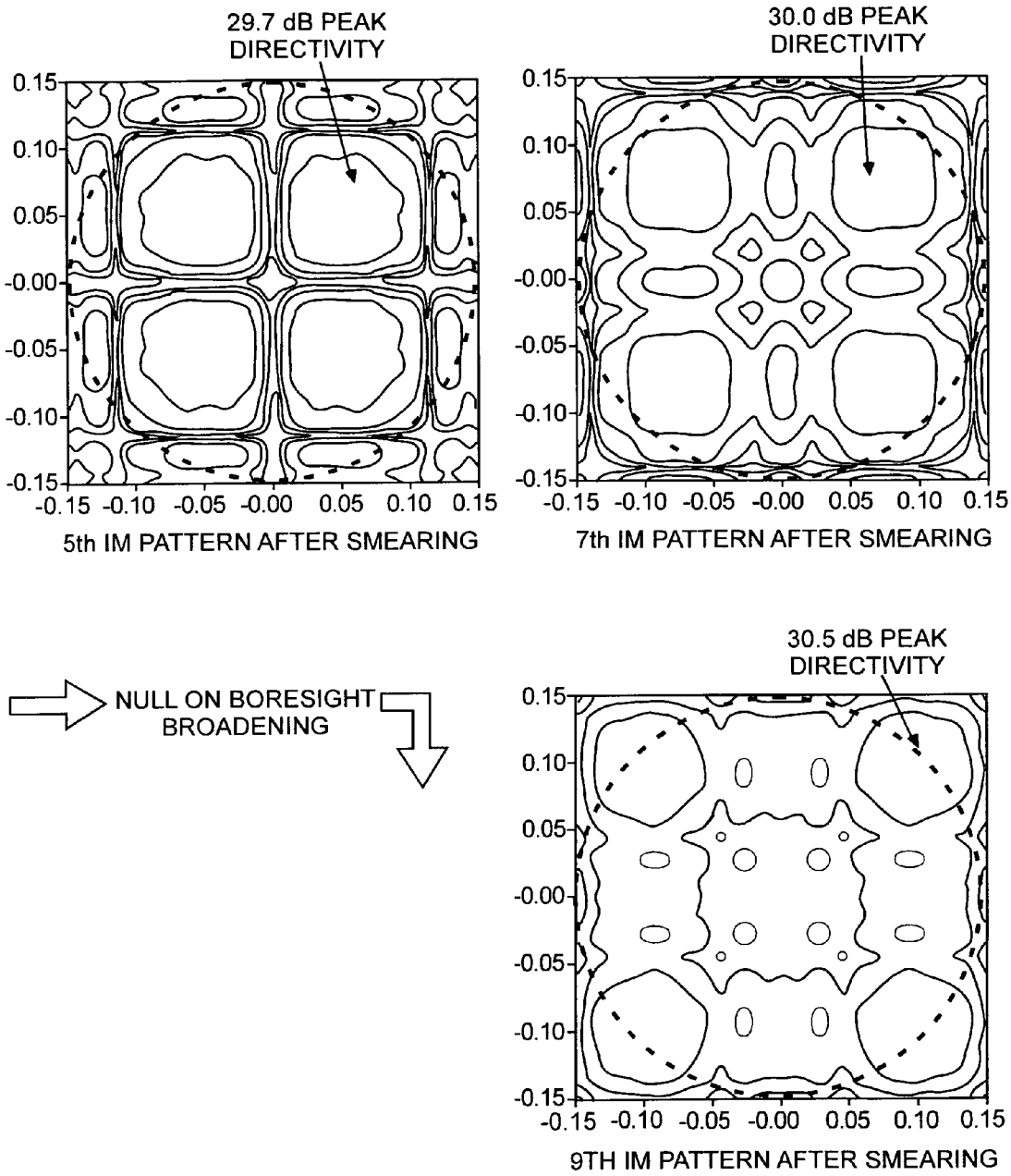

The third scenario tabulated in FIG. 11 has been selected to meet a hypothetical requirement that a relatively large amount of fundamental beam degradation can be tolerated. In this example scenario—achieved using a smear phase of 0° and a smear angle of 0.65°—the fifth-, seventh- and ninth-order beams are degraded by 12.0, 11.7 and 11.2 dB respectively while the fundamental beams are degraded by 1.1 dB. The directivity patterns for the third scenario before and after smearing are shown in FIGS. 14A and 14B. The fundamental spot beam is again virtually unchanged, with only the sidelobe structure significantly altered. Again, the increasing effects of smearing for increasing intermodulation beam order are evident, with a boresight null and quadripartite beam already visible in the fifth-order pattern. The seventh- and ninth-order patterns display increasingly broadening boresight nulls. In this example, the peak directivities for the fifth-, seventh-, and ninth-order intermodulation patterns are 29.7, 30.0, and 30.5 dB respectively.

Figure 15:
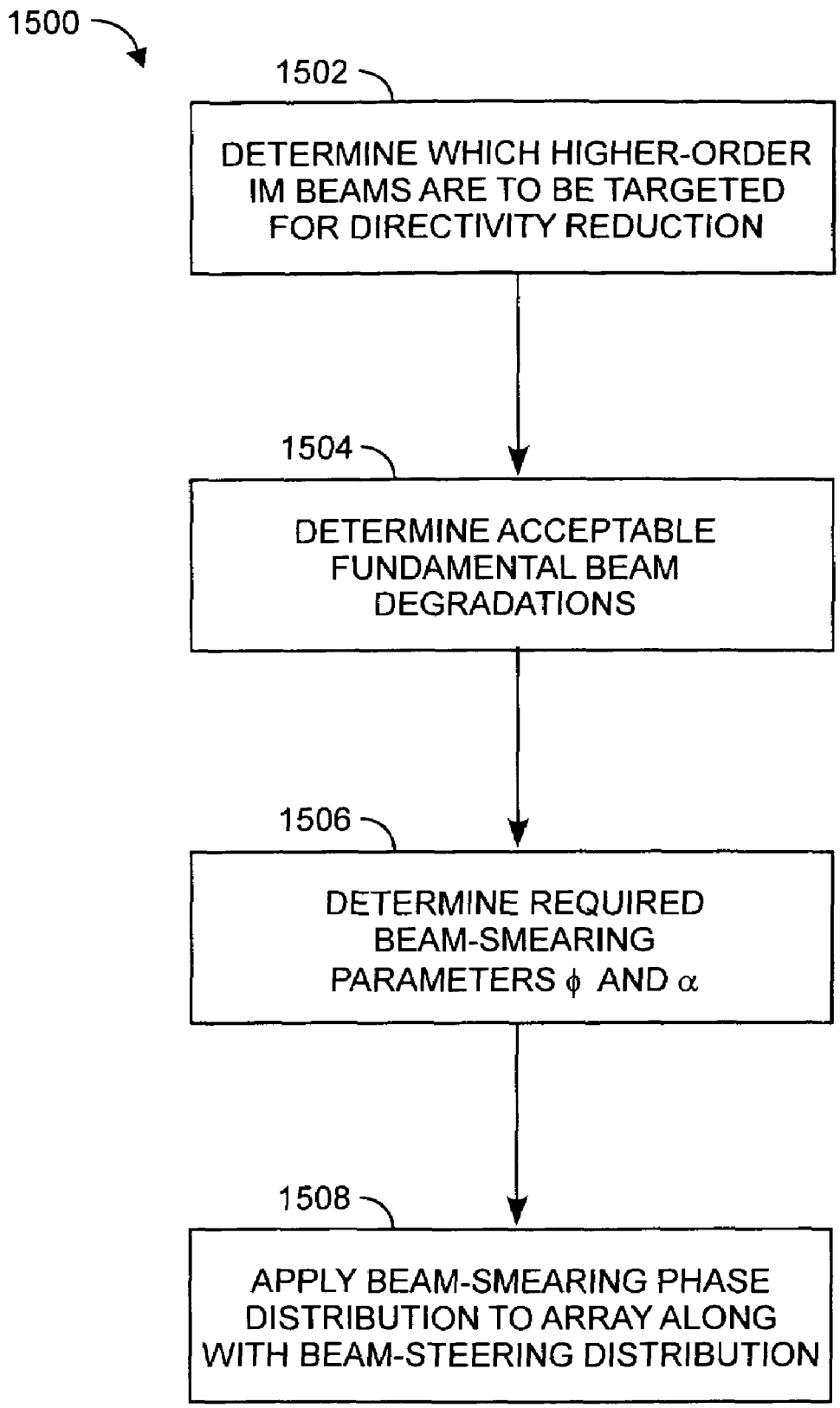
FIG. 15 illustrates an example method for reducing intermodulation beams.
Figure 16:
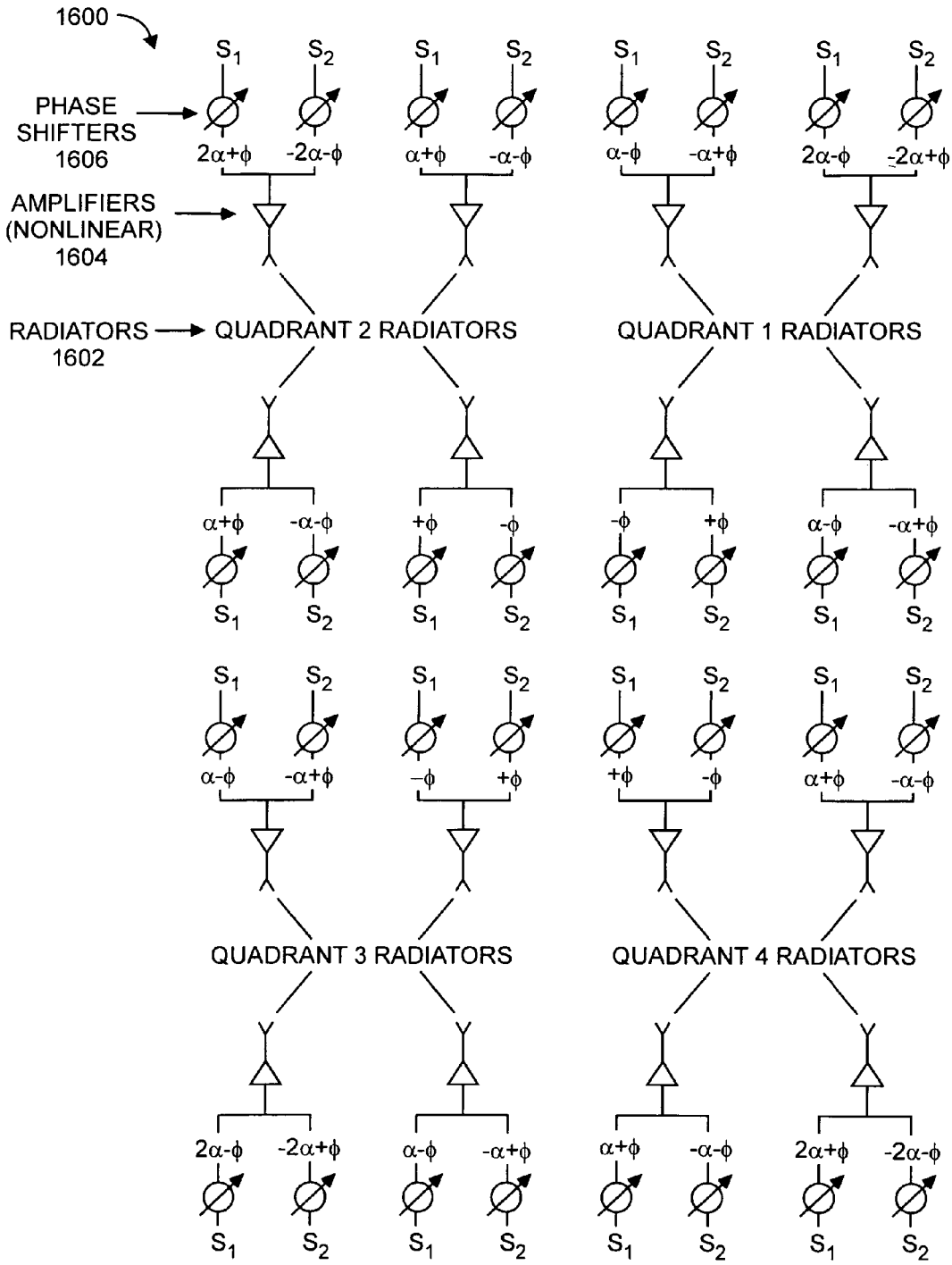
FIG. 16 illustrates an example system for reducing intermodulation beams.

FIG. 15 illustrates an example method for reducing intermodulation beams. In this example embodiment, an intermodulation beams reduction method 1500 includes determining which higher-order IM beams are to be targeted for directivity reduction (at 1502), determining acceptable fundamental beam degradations (at 1504), determining required beam-smearing parameters $\phi$ and $\alpha$ (at 1506), and applying a beam-smearing phase distribution to the array along with a beam-steering distribution (at 1508). For example, if the only concern is with reducing the fifth-order beam directivity as much as possible subject to a maximum fundamental beam directivity reduction of 1 dB, in an example embodiment, a smear phase of 0 degrees and a smear angle of 0.6 degrees are chosen, resulting in 11.5 dB reduction of the fifth-order beams, as shown in FIG. 8. In the circuit of FIG. 16 (discussed below), in this example, one would then set $\phi$ to 0 and $\alpha$ to the uniform progressive phase required to scan the fundamental quadrant beams by 0.6 degrees.

In an example embodiment, a method for reducing intermodulation beams includes identifying one or more higher-order intermodulation beams that are to be targeted for a directivity reduction, determining acceptable degradations for fundamental beams associated with the one or more higher-order intermodulation beams, determining phase and angle beam-smearing parameters $\phi$ and $\alpha$ that target the one or more higher-order intermodulation beams identified and provide the acceptable degradations to the fundamental beams, and using the phase and angle beam-smearing parameters $\phi$ and $\alpha$ to apply a beam-smearing phase distribution to an array along with a beam-steering distribution.

The phase and angle smearing method described herein provides significant degradation of undesirable higher-order intermodulation beams caused by nonlinear effects in communication systems. The described method typically results in the degeneration of highly directive intermodulation beams to deep nulls that broaden as the beam order increases. This higher-order beam degradation can be achieved with minimal impact on the fundamental spot beams required for communication. By way of example, with a 14×14 array design, if a fundamental beam degradation of just 0.2 dB can be tolerated, the fifth-, seventh-and ninth-order beams can all be degraded by more than 6 dB. Alternatively, if a fundamental beam degradation of 1.1 dB can be tolerated, the fifth-, seventh- and ninth-order beams can all be degraded by more than 11 dB.

Referring to FIG. 16, in another example embodiment, an intermodulation beams reduction system 1600 includes a 16-element, 4×4 array for reducing higher-order IM beams. In this example embodiment, radiators 1602 are configured in four quadrants as shown, and amplifiers 1604 (e.g., nonlinear amplifiers) and phase shifters 1606 are operatively connected to the radiators 1602 as shown. In a scenario where third-order as well as higher-order intermodulation beams are problematic, in an example embodiment, FIG. 16 is modified by replacing each amplifier and the power combiner that feeds it with an intermodulation cancellation circuit such as the intermodulation cancellation circuit 300 of FIG. 3.

The intermodulation beams reduction system 1600 is merely one example of systems and hardware configurations of the present invention that can provide improved communication system performance. By way of example, the principles described herein can be used for satellite antenna arrays or any application generally requiring arrays for generating multiple simultaneous beams in the presence of nonlinear effects.

Although the present invention has been described in terms of the example embodiments above, numerous modifications and/or additions to the above-described embodiments would be readily apparent to one skilled in the art. It is intended that the scope of the present invention extend to all such modifications and/or additions.

What is claimed is:

1. A method for reducing intermodulation beams, comprising:

applying a beam-smearing phase distribution in addition to a beam-steering distribution for scanning to an array of antenna elements such that multiple higher-order intermodulation products are simultaneously reduced.

2. The method for reducing intermodulation beams of claim 1, wherein the beam-smearing phase distribution is independent of the beam-steering distribution.

3. The method for reducing intermodulation beams of claim 1, wherein the higher-order intermodulation products include fifth-order intermodulation products.

4. The method for reducing intermodulation beams of claim 1, wherein the higher-order intermodulation products include seventh-order intermodulation products.

5. The method for reducing intermodulation beams of claim 1, wherein the higher-order intermodulation products include ninth-order intermodulation products.

6. The method for reducing intermodulation beams of claim 1, wherein the higher-order intermodulation products include fifth-, seventh-, and ninth-order intermodulation products.

7. A method for reducing intermodulation beams, comprising:

identifying one or more higher-order intermodulation beams that are to be targeted for a directivity reduction;

determining acceptable degradations for fundamental beams associated with the one or more higher-order intermodulation beams;

determining phase and angle beam-smearing parameters $\phi$ and $\alpha$ that target the one or more higher-order intermodulation beams identified and provide the acceptable degradations to the fundamental beams; and using the phase and angle beam-smearing parameters $\phi$ and $\alpha$ to apply a beam-smearing phase distribution to an array along with a beam-steering distribution.

8. The method for reducing intermodulation beams of claim 7, wherein the directivity reduction is greater than the acceptable degradations.

9. The method for reducing intermodulation beams of claim 7, wherein at least one or more higher-order intermodulation beams is higher than third-order.

10. The method for reducing intermodulation beams of claim 7, wherein the one or more higher-order intermodulation beams include a fifth-order intermodulation beam.

11. The method for reducing intermodulation beams of claim 7, wherein the one or more higher-order intermodulation beams include a seventh-order intermodulation beam.

12. The method for reducing intermodulation beams of claim 7, wherein the one or more higher-order intermodulation beams include a ninth-order intermodulation beam.

* * * * *